US005848606A

United States Patent [19]

Zimmer et al.

[11] Patent Number: 5,848,606

[45] Date of Patent: Dec. 15, 1998

[54] DEVICE FOR DISTRIBUTING POURABLE MEDIUM

[75] Inventors: Johannes Zimmer, Klagenfurt; Karl M. Wechselberger, Ebbs, both of Australia

[73] Assignee: J. Zimmer Maschinebau Gesellschaft m.b.H., Kufstein, Austria

[21] Appl. No.: 649,104

[22] Filed: May 17, 1996

[30] Foreign Application Priority Data

May 18, 1995 [AT] Austria ..... 842/95

[51] Int. Cl.[6] ..... B05C 5/02

[52] U.S. Cl. ..... 137/561 A

[58] Field of Search ..... 137/561 A, 561 R

[56] References Cited

U.S. PATENT DOCUMENTS

| | | | |
|---|---|---|---|
| 4,550,681 | 11/1985 | Zimmer et al. . | |
| 4,840,018 | 6/1989 | Deutsch | 137/561 A |
| 4,922,958 | 5/1990 | Lemp | 137/561 A |
| 5,474,102 | 12/1995 | Lopez | 137/561 A |
| 5,531,888 | 7/1996 | Geiger et al. | 137/561 A |

FOREIGN PATENT DOCUMENTS

| | | |
|---|---|---|
| 154931 | 9/1986 | European Pat. Off. . |
| 277481 | 8/1988 | European Pat. Off. . |
| 475412 | 3/1992 | European Pat. Off. . |
| 2520623 | 11/1976 | Germany . |
| 3335252 | 4/1984 | Germany . |
| WO94/17927 | 8/1994 | WIPO . |

*Primary Examiner*—Marguerite McMahon
*Attorney, Agent, or Firm*—Fay, Sharpe, Beall, Fagan, Minnich & McKee

[57] ABSTRACT

A device for distributing a flowable medium over the application width of an applying machine includes a pipe that has at least one medium-carrying conduit and a number of exit openings for the medium that lead outwardly through the pipe wall from the inside of the pipe, where the exit openings are spaced evenly over the length of the pipe. To improve distribution over width and to make cleaning and handling easier, the pipe wall is made of reinforced plastic at least over part of the pipe length, thus forming an inner pipe wall that extends straight in that part of the pipe, has accurate shape and dimensions and a smooth inner surface, and is provided with the exit openings.

11 Claims, 3 Drawing Sheets

DEVICE FOR DISTRIBUTING POURABLE MEDIUM

Figure 1:
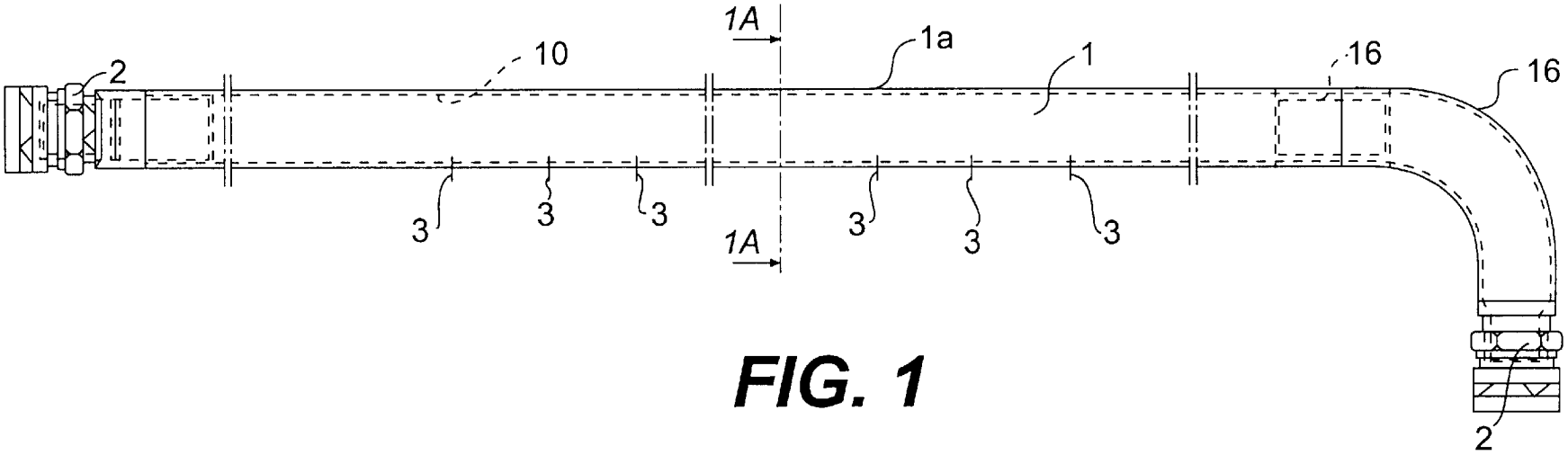

The invention relates to a device for distributing pourable or flowable medium, in particular coloring agents, over the application width of a station of a screen printing machine, and includes a pipe that has at least one medium-carrying conduit and a number of exit openings for the medium that lead outward through the pipe wall from the inside of the pipe, where the exit openings are spaced evenly over the length of the pipe.

It is generally known and customary to provide a pipe with a number of openings spaced evenly over the length of the pipe in order to distribute mediums such as coloring agents or cleaning fluid over the working length of a printing station in a printing machine (compare to EP-A3-0 277 481). In particular in order to obtain the most even distribution of medium possible over large working widths of 5 m and more, a distributing body is inserted into a pipe. This distribution body is a branching system obtained through repeated division (DE-A1-33 35 252). WO-A-94/17927 discloses a distribution device with a multi-part conduit insert body, wherein supplemental devices are also connected to the pipe, which comprise a doctor retaining device, a doctor guiding device, and/or parts of the conduit system. The supply pipes of the known devices are made of metal. Preferably stainless steel pipes are provided in order to produce the greatest possible strength to prevent deflection, particularly with large working widths of several meters. The precision of the inner dimensions of available steel pipes is relatively low and also the quality of the inner pipe surface that at least partially constitutes the wall of a supply conduit leaves a lot to be desired with regard to unobstructed and reproducible substance flow, particularly for small and low-pressure substance quantities. Furthermore, insufficiently smooth inner conduit walls present with considerable difficulties in cleaning, particularly with the throughput of large quantities of cleaning fluid. In order to improve internal precision, aluminum pipes are provided, which do not, however, have satisfactory resistance to deflection. It is true that aluminum pipes, with their lighter weights than steel pipes, are in themselves easier to handle, which is very desirable per se, in particular for setting up and taking down in the narrow space of perforated cylinder rotary screens and with pipe lengths over several meters. However, in order to counteract deflections, additional stiffening walls and/or clamping devices must be provided (WO-A-94/17927). In particular when conventional metal pipes are equipped with an insert body that has distribution conduits for distributing medium over a width, considerable sealing problems arise. On its upper face, an insert body with the desired multi-stage distribution system has input end and output end conduit sections that are closely adjacent to one another. Imprecisions in the fit between inner pipe wall and insert body surface with gaps on the order of 1/10 mm lead to extraordinarily disadvantageous bypass and secondary flows, which severely impair the material distribution over the width and when printing in a printing machine, are connected with considerable costs due to rejects which occur. From time to time, pipes with distribution bodies even become unusable if substance residues resulting from undesirable gaps cannot be removed by cleaning.

The object of the invention is to make a distribution device with a pipe having exit openings for the even distribution of a medium over a width, in which the internal quality of the pipe is improved with regard to dimensional and shape accuracy in the conduit region under static loading and dynamic loading during operation, and the surface finish of the pipe's inner wall is improved, particularly for large working widths of 5 meters and above, where the device should be lightweight and space saving as well as economical to produce.

The object is attained in connection with the features of the device mentioned at the beginning by virtue of the fact that the pipe wall is made of reinforced plastic at least over a part of the pipe length, where the pipe wall made of reinforced plastic constitutes an inner pipe wall that has accurate shape and dimensions, extends straight in the pipe span, and is provided with exit openings. Experience has shown that the pipe wall that is made with reinforced plastic and provided at least partially as an inner conduit wall, by means of its shape and dimensional precision when statically and dynamically loaded, as well as by means of the fineness and/or smoothness of the surface guiding the medium, leads to a number of yield, function, and material advantages that combine in a particularly favorable manner with regard to manufacturing, managing, and operating the pipe distribution device. Common impairments to the evenness of guidance and flow of the medium due to wall unevennesses or curvatures as a result of deflection, cross sectional deviations over the flow path, and surface obstructions are eliminated. This permits operation with a wide variety of flow mediums as well as with low and high throughput, also in particular with low pressure feed. The reduction of residues improves cleaning of the distribution pipe interior. Furthermore, in comparison to conventional metal pipes, the distribution pipe with a reinforced plastic wall according to the invention not only achieves a weight reduction that makes handling easier, but also achieves great stability and mechanical strength that is satisfactory in operation with a relatively small cross section. Pipe cross sections similar to those used with stainless steel pipes can be provided in order to retrofit existing systems with the new, much lighter distribution pipes. This produces considerable weight savings and thereby ease of handling. For example, a stainless steel distribution pipe approximately 4 m long weighs approximately 21 kg; a distribution pipe according to the invention, made of carbon fiber reinforced plastic (carbon fiber laminate), together with the distribution device disposed in it, weighs approximately 10 kg, which is to say less than half. It should be emphasized that in comparison to steel pipes, the existing weight and strength advantages of reinforced plastic pipes, disclosed as such for example in DE-B2-25 20 623, supplement the other advantages mentioned because of the internal embodiment of the distribution pipe that is adapted for distribution over width according to the invention.

Preferably, the reinforced plastic of the pipe wall is comprised of fiber reinforced plastic; in particular it is advantageously comprised of carbon fiber reinforced plastic which is distinguished by particularly high strength. In general, pipes of reinforced plastic have a slightly conical internal shape with a resultant pipe cross section that does not remain precisely the same over the length of the pipe. Even slight changes in straightness and/or cross section are disadvantageous for the purposes of the invention. According to the invention, therefore, what matters is the precise accuracy of shape and dimensions of the inner pipe wall over the entire straight span. Experience has shown that particularly favorable properties of the pipe distribution device are produced if a maximum diameter deviation relative to a pipe length of at least one meter lies in the region of a fraction of a millimeter and in particular, is smaller than 0.1 mm.

A particularly advantageous embodiment of the invention is comprised in that an insert body is inserted into the pipe or the pipe section made of reinforced plastic and when inserted, is as precisely equal in shape and cross section to the inner pipe chamber as possible. The insert body, which rests at least partially against the pipe's inner wall, is advantageously embodied as a distribution device for evenly distributing the pourable medium supplied to the individual exit openings, where flow conduits that lead from a main supply constitute a preferably symmetrical branching system obtained through repeated conduit division. Dimensional accuracy, shape accuracy, and internal precision of the distribution pipe according to the invention are essential to the satisfactory width distribution function of the insert body.

In particular when using an insert body in which the flow conduits are formed in the body surface as grooves, according to an embodiment of the invention it is particularly advantageous that the insert body is provided as a body inserted into the pipe interior in a snug press fit and is preferably comprised of a material that can shrink in size when cooled, that in the cooled state, the body can be easily slid into the pipe interior and when it heats up to room temperature, assumes a larger profile cross section volume producing the snug press fit. The insert body can very advantageously be comprised of a material such as polyethylene, which on the one hand assures the desired contraction and expansion function that can be set by means of the material and on the other hand, comprises an optimum glide face for the medium and for insertion into the pipe from the end face. The material can be easily machined and furthermore, an insert body made of plastic is low in weight. In addition to the advantages mentioned, the overall stability and rigidity of the composite unit composed of the reinforced plastic pipe and the insert body is further Improved. It is particularly advantageous to provide flow conduits as radially extending grooves that are open toward the body surface so that the remaining radial ribs nevertheless ensure sufficient lateral and axial rigidity.

It is particularly advantageous that the reinforced plastic pipe can be provided as a hollow body that can be produced by plastic and fiber material wound around a die arbor. A particularly favorable fineness and smoothness of the inner pipe surface is produced by means of an arbor with a very finely polished surface, where the precise cross sectional size is also predetermined by the die shape. It is also very advantageous that the pipe can be made as a high precision polygonal hollow body, in particular in the form of a wound pipe, that constitutes a fitted cross section for rotationally secure and precisely fitted positioning, specifically for an insert body. As a result, the conduit ends on the circumference of the insert body can be simply brought into a precisely fitted position in front of the associated exit openings in the pipe wall.

The reinforced plastic distribution pipe according to the invention is particularly suitable for connecting to a supplemental device that is connected to the pipe over at least a part of the pipe length. It is particularly good to glue the supplemental device to the pipe. As a result, a statically stable overall unit with an enlarged cross section is produced. In screen printing machines, particularly rotary screen printing machines, the supplemental device is favorably embodied as a doctor device. A carrier of the supplemental device can have a strip of elastic material. This strip can either be embodied itself as a coating doctor or can be disposed next to a revolving doctor.

Further particularly useful and advantageous embodiments or potential embodiments of the invention can be seen from the dependent claims and are described in further detail in conjunction with the following description of the exemplary embodiments shown in the schematic drawings.

Figure 2:
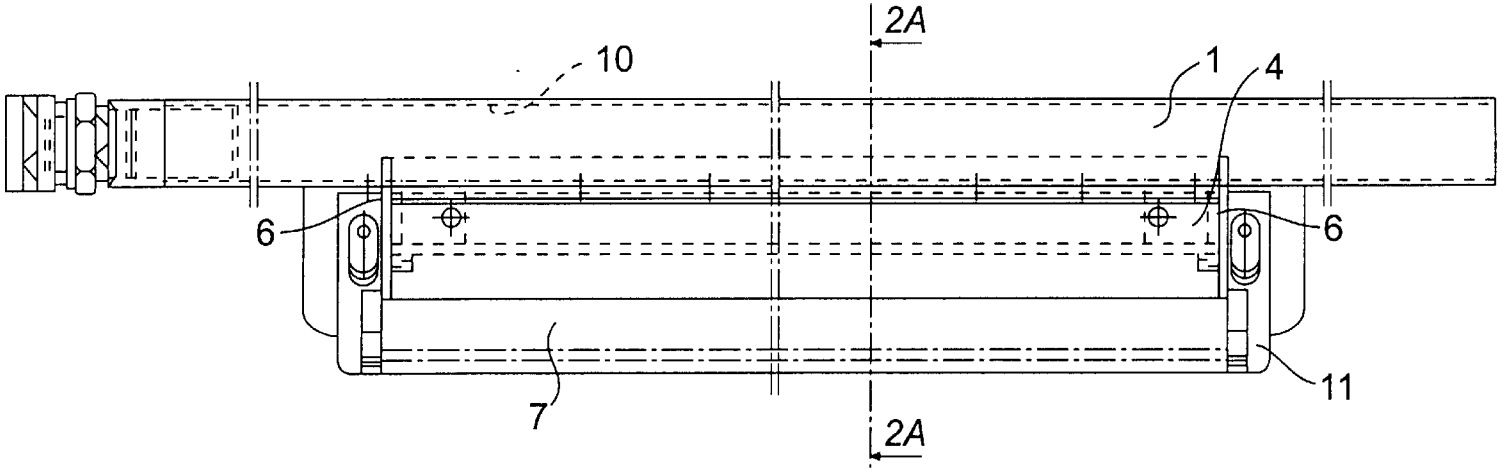
Figure 1A:
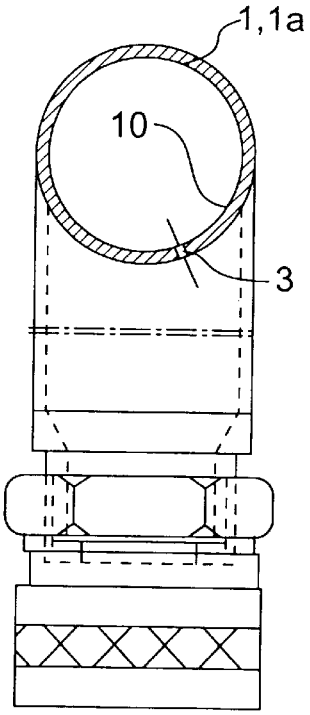
Figure 2A:
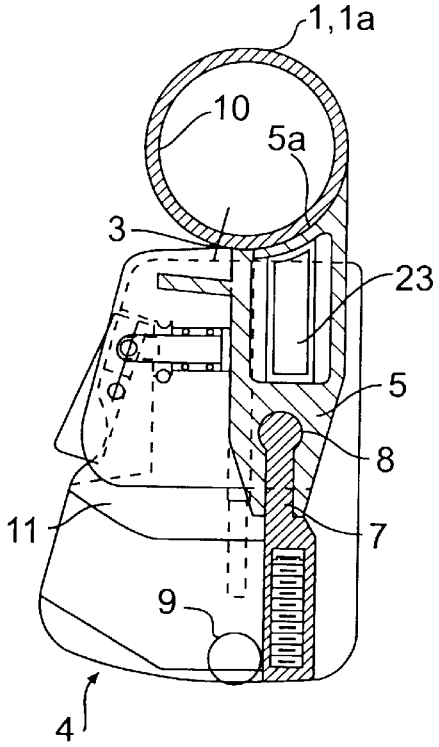
Figure 3A:
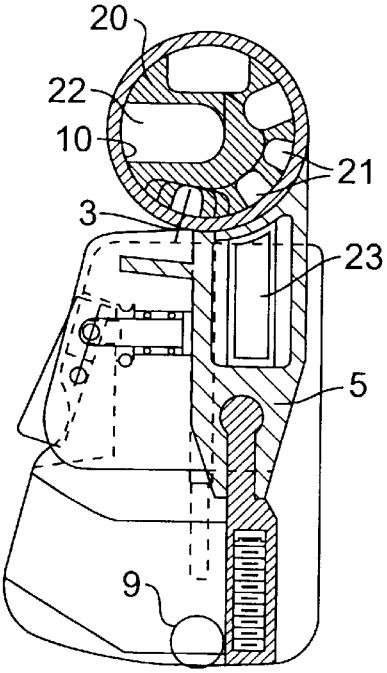
Figure 4:
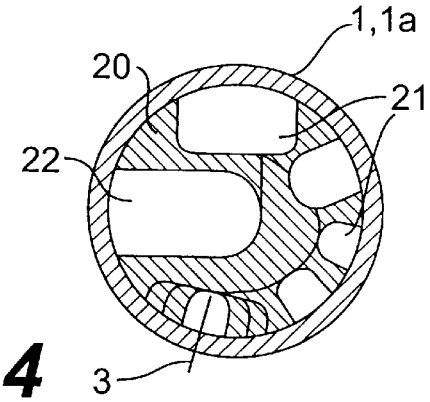
Figure 5:
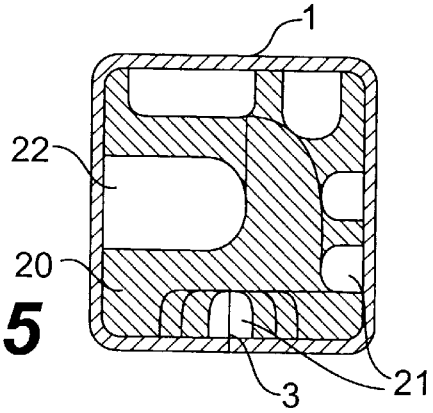
Figure 3:
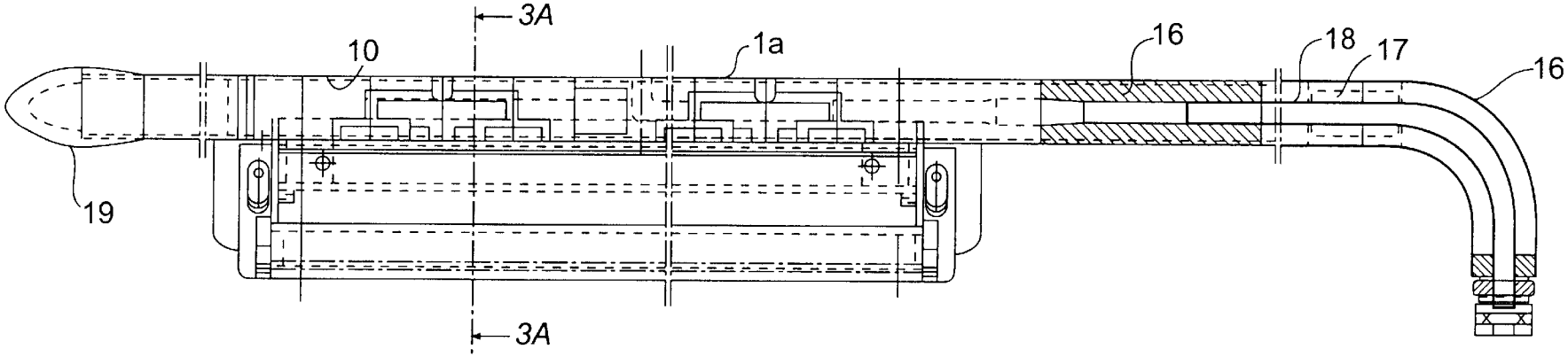
Figure 6:
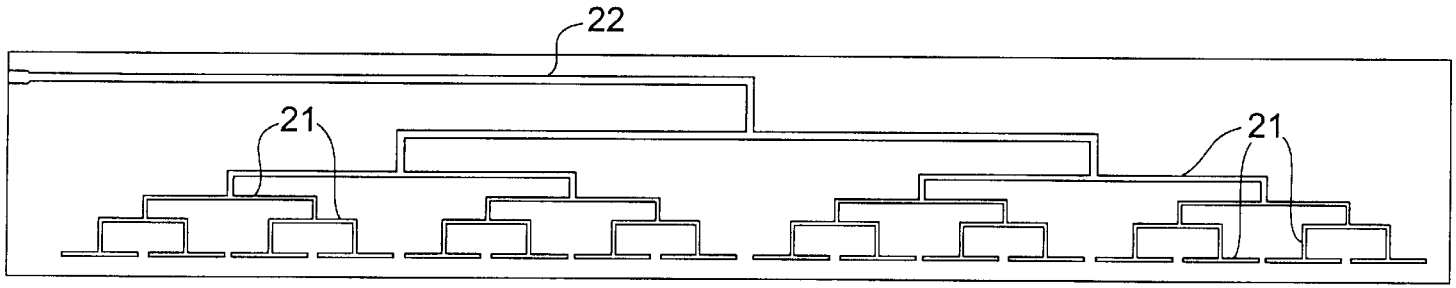

FIG. 1 shows an exemplary embodiment of a device according to the invention for distributing pourable medium, which device constitutes a color distribution pipe for a rotary screen printing device, FIG. 1A shows a sectional view taken along line 1A—1A; in FIG. 1, FIG. 2 shows an exemplary embodiment of a device according to the invention, with a glued-on supplemental device that constitutes a doctor device, FIG. 2A shows a sectional view taken along line 2A—2A; in FIG. 2, FIG. 3 shows a longitudinal section through an exemplary embodiment of a device according to the invention, which is equipped with an insert body that has a conduit system, FIG. 3A shows a sectional view taken along line 3A—3A; in FIG. 3, FIGS. 4 and 5 show a cross section through a cylindrical and a square distribution pipe, respectively,with a distribution body, and FIG. 6 shows the position of flow conduits on an unwound circumference of an insert body that is by and large cylindrical.

FIGS. 1 and 1A show a color distribution pipe 1 that is equipped on both ends with an end piece and connecting pieces 2 for connecting to a line supplying a medium such as a coloring substance. Pressurized coloring substance can be fed into the interior of the color pipe 1, which coloring substance comes out distributed via small clear exit openings 3 on the underside of the color pipe and is then applied, for example in a conventional manner, to a continuous material through a screen stencil by means of a doctor device.

According to the invention, a straight, extending wall of the pipe 1 is comprised of carbon fiber reinforced plastic (carbon fiber laminate) that is a lightweight and rugged composite material. The straight pipe section is comprised of a hollow, cylindrical pipe with a circular cross section, whose inner wall 10 is extraordinarily smooth and fine. Furthermore, the precision of the cylindrical pipe is extremely high. The straight, hollow, cylindrical pipe is obtained by virtue of the fact that carbon fiber laminate material, for example in the form of at least one arc of material is wound in a single layer or a number of layers around a very finely polished die arbor. For example, a pipe has been achieved in which the inner diameters at the pipe ends deviate from each other by only 0.02 mm.

In the exemplary embodiment shown in FIGS. 2 and 2A, the straight, hollow, cylindrical pipe of the color pipe 1 is attached to a supplemental device, labelled as a whole with 4, by means of an adhesive connection. The supplemental device 4 is embodied as a doctor guiding device that extends parallel to the pipe. It has a carrier 5 made of plastic, preferably of polyoxymethylene (POM). The carrier 5 has a region 5*a* that is embodied so that it is adapted to the outer shape of the pipe 1 and is glued to the pipe 1. The carrier 5 is embodied as a statically favorable hollow profile that counteracts a deflection over the length of the device and has a hollow chamber 23 that has one or more chambers Both ends of the hollow carrier profile are covered with detachable side parts 6.

The carrier 5 of the supplemental device 4 has a strip 7 that is preferably comprised of elastic material such as rubber. This strip 7 is detachably connected to the carrier 5. To this end, the carrier 5 has a groove 8 that is widened at the bottom into which the correspondingly profiled strip 7 can be inserted in the axial direction. The strip 7 can be embodied as a coating doctor. In the exemplary embodiment shown in FIGS. 2 and 2*a*, though, a separate revolving doctor 9 is disposed next to the strip 7 so that reduced demands are placed upon the precision of the strip 7. A magnet is disposed in the strip 7 and when the entire color pipe unit is removed from a rotary screen, not shown, of a printing machine, this magnet takes the loose, guided revolving doctor 9 along with it. In operation, the revolving doctor 9 is pressed in the usual manner against the rotary screen and a continuous material by means of a magnet system.

Doctor guides 11 are detachably fastened to the side parts 6 of the carrier 5 and are also embodied as color limiters.

A color distribution pipe 1 according to FIG. 3 and 3A is divided into two pipe sections 1*a* and 1*b*. Section la is constituted by a straight, hollow, cylindrical pipe, while section 1*b* is a curved piece of pipe. Sections 1*a* and 1*b* are connected to each other by a transition piece 16. A supply pipe 18 secured by a spacer 17 feeds into the transition piece 16. The color pipe 1 is closed by a stopper 19 on its other end.

On the end opposite the supply pipe 18, the transition piece 16 feeds into an insert body 20 that is inserted with an accurate shape and fit into the interior of pipe section 1*a*. The insert body 20 constitutes a distribution device for evenly distributing the coloring substance supplied to the exit openings 3 that are spaced along the pipe. To this end, the insert body 20 is provided with flow conduits 21 that lead from a main supply 22 and comprise a symmetrical branching system obtained through repeated division. This can be seen in the circumferentially unwound depiction according to FIG. 6. The insert body 20 is embodied of polyethylene. Because of a material choice of this kind, it is advantageously possible that the insert body can be easily inserted into pipe section 1*a* in the form of a plastic rod that is reduced in cross sectional size by means of cold treatment. By heating the material to room temperature, the rod expands so that it comes into full contact with the inner pipe wall in a snug press fit. In this manner, the grooves of the insert body are sealed on the circumference end and particularly tight transitions are produced between the openings of the conduit ends of the insert body 20 and the exit openings 3 in the pipe wall 1*a*. Because of the shape and dimensional accuracy of the carbon fiber laminate pipe, no gaps occur between insert body 20 and inner pipe wall 10, even during operation of the device.

In FIG. 4, the cross section of pipe section 1*a* is shown enlarged along with the carbon fiber laminate pipe wall and the cylindrical insert body 20 of the embodiment according to FIG. 3A. It can be particularly suitable to provide a pipe and insert body cross section that is rectangular and in particular, square, as shown in FIG. 5.

As can be seen from FIGS. 3A and 4, the insert body 20 has a cylindrical shape that corresponds to the inner chamber of the straight pipe section 1*a*. The flow conduits 21 are radially extending grooves that are milled or cut into the cylinder's surface. The main supply 22 is also embodied as a radial groove.

According to FIGS. 3 and 3A, the device according to the invention is equipped with a supplemental device 4 as described with respect to FIGS. 2 and 2A. Both the insert body 20 and the supplemental device 4 support the static strength and shape accuracy of the color pipe device that are achieved by the fiber reinforced plastic pipe. The diameter of the pipe can also be additionally reduced to a certain point by embodying statically favorable structures of the insert body 20, for example by means of the radially disposed grooves, and of the supplemental device 4 by means of the hollow chamber 23 with a number of chambers. By choosing material for the pipe according to the invention, and if need be, by combining this with the above mentioned static calculation of the supplemental device, relatively small pipe cross sections can be achieved, in particular in the range from 7 $cm^2$ to 25 $cm^2$, which are required for pipe distribution devices that are to be disposed in perforated cylinder rotary screens.

The invention is not limited to the exemplary embodiments shown. A device according to the invention is suitable for distribution over width of a great variety of pourable or flowing mediums, for example for adhesives as well.

We claim:

1. An apparatus for distributing a flowable medium in an applying machine comprising:

a pipe having a plurality of exit openings;

at least a part of a length of the pipe having a wall comprised of reinforced plastic;

said wall comprising an inner wall that extends in a straight lengthwise direction, said inner wall having a smooth surface provided with exit openings and being of accurate and constant shape and dimensions; and an insert body inserted into said part of the length of the pipe and snugly fitted against said inner wall thereof, said insert body having flow conduits therein for evenly distributing the flowable medium to said exit openings.

2. An apparatus according to claim 1 wherein said part of the length of the pipe has an inner wall having a maximum diameter deviation relative to a pipe length of at least on meter smaller than 0.1 mm.

3. An apparatus according to claim 1, wherein the insert body is provided as a body that is inserted into the pipe interior in a snug press fit and is comprised of a material that can shrink in size when cooled, so that in the cooled state, the body can be easily slid into the pipe interior and when it heats up to room temperature, assumes a larger profile cross section volume that produces the snug press fit.

4. An apparatus according to claim 1, wherein the flow conduits are at least partially embodied as grooves that extend radially, particularly in the pipe profile cross section, and are formed in the body surface.

5. An apparatus according to claim 1, wherein the insert body is comprised of polyethylene.

6. An apparatus according to claim 1, wherein on at least one part of its length, the pipe is embodied as a hollow body in the form of a hollow cylinder of reinforced plastic.

7. An apparatus according to claim 1, wherein on at least one part of its length, the pipe is embodied as a hollow body that is polygonal in profile cross section.

8. An apparatus according to claim 6, wherein the hollow body made of reinforced plastic is a wound body that is comprised of pieces of material wound around a die with a polished surface.

9. An apparatus according to claim 1, wherein the inner cross section of the length of the pipe comprised of reinforced plastic is in the range of 7 $cm^2$ to 25 $cm^2$.

10. An apparatus according to claim 1, wherein the reinforced plastic of the pipe wall is a carbon fiber reinforced plastic.

11. An apparatus according to claim 1, wherein a doctor device for applying the flowable medium is positioned on the outside of and parallel to the length of pipe comprised of reinforced plastic.

* * * * *